US006644830B2

(12) United States Patent
Lewis et al.

(10) Patent No.: US 6,644,830 B2
(45) Date of Patent: Nov. 11, 2003

(54) HIGH OUTPUT LAMP SOFTENER

(75) Inventors: Randy Kent Lewis, Americus, GA (US); William Theodore Foley, III, Americus, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/998,213

(22) Filed: Dec. 3, 2001

(65) Prior Publication Data

US 2003/0103355 A1 Jun. 5, 2003

(51) Int. Cl.[7] ..... F21S 4/00

(52) U.S. Cl. ..... 362/225; 362/224; 362/245; 362/327

(58) Field of Search ..... 362/260, 223, 362/224, 300, 351, 311, 308, 332, 433, 444, 327, 329, 225, 240, 241, 245

(56) References Cited

U.S. PATENT DOCUMENTS

| | | | | | |
|---|---|---|---|---|---|
| 4,939,627 | A | | 7/1990 | Herst et al. | 362/299 |
| 5,097,401 | A | | 3/1992 | Eppler | 362/298 |
| 5,128,846 | A | * | 7/1992 | Mills et al. | 362/224 |
| 5,228,773 | A | | 7/1993 | Win | 362/334 |
| 5,274,536 | A | | 12/1993 | Sato | 362/338 |
| 5,418,699 | A | * | 5/1995 | Tazawa | 362/255 |
| 5,486,990 | A | | 1/1996 | Sejkora | 362/309 |
| 5,746,502 | A | | 5/1998 | Huang | 362/223 |
| 5,823,656 | A | | 10/1998 | Waldmann | 362/147 |
| 5,865,528 | A | | 2/1999 | Compton et al. | 362/300 |
| 5,967,648 | A | | 10/1999 | Barnes, II et al. | 362/307 |
| D440,341 | S | | 4/2001 | Arumugasaamy | D26/85 |
| 6,210,025 | B1 | | 4/2001 | Schmidt et al. | 362/147 |
| 6,213,625 | B1 | | 4/2001 | Leadford et al. | 362/331 |

FOREIGN PATENT DOCUMENTS

| | | | | |
|---|---|---|---|---|
| GB | 400029 | * | 10/1933 | 362/224 |
| GB | 496979 | * | 12/1938 | 362/224 |

OTHER PUBLICATIONS

PCT Int'l Search Rep, Apr. 24, 2002.

Peerless Lighting Corporation—Mirage Web Page Article http://www.peerless–lighting.com/P40_image.htm, May 31, 2001.

Peerless Lighting Corporation—Mirage Web Page Article http://www.peerless–lighting.com/P40_image.htm, Apr. 3, 2001.

* cited by examiner

*Primary Examiner*—Y. My Quach-Lee
*Assistant Examiner*—Peggy A. Neils
(74) *Attorney, Agent, or Firm*—Thomas, Kayden, Horstemeyer & Risley LLP

(57) ABSTRACT

A high output lamp softener includes a base and at least one diffuser extending from the base toward an interior of the base and defining a surface configured to encircle a portion of a circumference of a high output lamp.

18 Claims, 12 Drawing Sheets

(PRIOR
ART)

(PRIOR
ART)

(PRIOR
ART)

(PRIOR
ART)

HIGH OUTPUT LAMP SOFTENER

TECHNICAL FIELD

This invention relates to high output fluorescent lamp fixtures, and more particularly to a softener for a high output fluorescent lamp fixture.

BACKGROUND

Referring to FIG. 1, a conventional high output fluorescent lamp fixture 10 tends to produce maximum illumination immediately below and along the length of the high output fluorescent lamp 15. This can cause glare while leaving shadows in other areas where illumination is desired. Methods for reducing glare and providing more uniform illumination from a high output fluorescent lamp fixture are well known. For example, referring to FIG. 2, the conventional high output fluorescent lamp fixture 10 includes a housing 20, a reflector 25, one or more high output fluorescent lamps 15, and a sheet diffuser 30.

To provide more even illumination, the sheet diffuser 30 disperses direct lighting emanating from the lamp 15 and indirect lighting reflected by the fixture's reflector 25. The sheet diffuser 30 can have a perforated or ridged surface for increased light dispersion. Referring to FIGS. 3 and 4, the sheet diffuser may be installed as a lens cover diffuser 35 (FIG. 3) that is positioned at the bottom of the housing 20 or as an overlay diffuser 40 that is installed inside the lamp fixture 10 (FIG. 4).

A desire for increased brightness levels has resulted in the development of high output lamps. However, the increased brightness level from these high output lamps increases the potential for discomfort, harsh glare, or shadows. Conventionally, the glare from the high output lamps is minimized by reducing the transmissive properties of the sheet diffuser 30 such that the lamp's brightness level is comparable to that produced by a standard high output fluorescent lamp fixture.

SUMMARY

In one general aspect, a high output lamp softener includes a base and at least one diffuser extending from the base toward an interior of the base and defining a surface configured to encircle a portion of a circumference of a high output lamp.

Implementations of the high output lamp softener may include one or more of the following features. For example, the surface of the diffuser may be configured to be positioned below a portion of the circumference of a high output lamp. The surface of the diffuser may be configured to follow the contour of a high output lamp. The surface of the diffuser may be configured to be a constant distance from a high output lamp when the high output softener is mounted in a lamp fixture comprising a high output lamp. The diffuser may include a pair of diffusers.

The diffuser may include a translucent material. The translucent material may transmit between approximately 60% and 80% of direct light emitted from a high output lamp. The translucent material of the diffuser may reduce the total light level from a high output fluorescent lamp fixture by between approximately 25% to 35% more than that provided by a standard fluorescent lamp fixture. The translucent material may include a polymer and an additive that reduces the transmissivity of light through the diffuser.

The base may include a transparent material. The diffuser may include a curled edge that extends from the surface toward the fluorescent lamp. The base may include a lens cover for a lamp fixture. The high output lamp softener may further include one or both of a high output lamp and a reflector. The base may be configured to be mounted to the lamp fixture and the diffuser may be configured to be mounted to the reflector. The lamp softener may include one or more fasteners for mounting the lamp softener to one or both of the lamp fixture and a high output lamp. The base and the diffuser may be co-extruded integral components.

In another general aspect, a high output lamp softener may include at least one diffuser having a surface that is configured to encircle a portion of a circumference of a high output lamp and to be positioned in close proximity to a high output lamp. The lamp softener reduces the apparent lighting of the high output lamp while maximizing the reflected lighting emanating from the high output lamp.

Implementations of the high output lamp softener may include one or more of the following features. For example, the diffuser may include one or more fasteners that are configured to mount the softener to a lamp fixture. The fastener may include one or more clips that are configured to mount the lamp softener to a high output lamp. The surface of the diffuser may extend from underneath the high output fluorescent lamp and arc upwardly toward the sides of the high output lamp fixture. The diffuser may include a pair of diffusers.

The diffuser may include a translucent material. The translucent material of the diffuser may transmit between approximately 60% and 80% of direct light emitted from a high output lamp. The translucent material of the diffuser may reduce the total light level from a high output fluorescent lamp fixture to between approximately 25% and 35% more than that provided by a standard fluorescent lamp fixture. The translucent material may include a polymer and an additive that reduces light transmissivity through the diffuser.

The diffuser may be configured to encircle approximately 180° of the circumference of a lamp, between approximately 90° and 180° of the circumference of a lamp, or approximately 360° of the circumference of a lamp. The diffuser may include a flat surface.

In another general aspect, a lamp fixture includes a housing and a softener. The housing is configured to retain a fluorescent lamp. The softener includes a surface and is mounted adjacent to a fluorescent lamp to reduce the transmissivity of light through the surface. The surface includes a polymer and a filler that reduces the transmissivity of light through the surface.

Implementations of the lamp fixtures may include one or more of the following features. For example, the softener may include a fastener for mounting the softener. The fastener may include a clip for mounting the softener to a fluorescent lamp. The lamp fixture may further include a reflector and/or a lens. The diffuser may be configured to encircle approximately 180° of the circumference of a lamp, between approximately 90° and 180° of the circumference of a lamp, or approximately 360° of the circumference of a lamp. The diffuser may include a flat surface.

In another general aspect, the output of a lamp can be softened by providing a lamp softener that includes a surface that reduces the transmissivity of light through the surface and placing the lamp softener adjacent to the lamp such that the lamp softener encircles at least a portion of the circumference of the lamp. The surface includes a polymer and a filler that reduces the transmissivity of light.

Softening of the output of the lamp may include one or more of the following features. For example, placing the lamp softener adjacent to the lamp may include mounting the lamp softener to the lamp. The lamp softener and the lamp may be mounted in a lamp fixture. Mounting the lamp softener in the lamp fixture may include mounting the lamp softener to the lamp fixture and/or mounting the lamp softener to the lamp. The softener may include a translucent material and the translucent material may transmit between approximately 60% and 80% of direct light emitted from a high output lamp. The softener may encircle approximately 180° of the circumference of the lamp, between approximately 90° and 180° of the circumference of the lamp, or approximately 360° of the circumference of the lamp.

The lamp softener provides considerable advantages. For example, the shape of the high output lamp softener works in conjunction with the luminaire's contours to distribute the concentrated brightness of the true source and to create a much softer looking apparent source. The shape also maximizes the reflectance of the luminaire's upper surfaces to eliminate shadows and to provide a more uniform brightness across the face of the luminaire. The high output lamp softener also reduces the harsh glare of high output lamps to more comfortable brightness levels without a significant reduction in the lighting intensity. The high output lamp softener also reduces shadows and provides more even light distribution than that provided by a high output fluorescent lamp fixture with a conventional sheet diffuser. The lamp softeners are advantageously configured and positioned adjacent to the lamp such that they reduce the apparent illumination seen below the lamp while simultaneously allowing the light from the lamp to reflect from the reflective surface of the lamp fixture, including those of the reflector or baffles and the housing. Thus, the softener provides illumination that is a mixture of direct lighting through the softener and light reflected from the reflective surfaces of the fixture.

The lamp softener also advantageously can be used to reduce the inventory of lamp bulbs that must be carried or stored in a large building or facility. For example, high output lamps, such as T-5 high output lamps, can be used throughout a building in both direct and indirect lighting applications. Because the illumination provided by the lamp will be too bright in some applications, a lamp softener can be placed around or adjacent to the lamp to provide a more comfortable level of illumination. Furthermore, because the softener advantageously does not reduce the reflected lighting, the lamp fixture will provide even and comfortable lighting. Because the softener can be optionally used, the maintenance staff of the building or facility can use the same lamp in many applications and then can use the softener in only those applications for which a softened apparent lighting is desired.

The details of one or more implementations are set forth in the accompanying drawings and the description below. Other features and advantages will be apparent from the description, the drawings, and the claims.

DESCRIPTION OF DRAWINGS

Like reference symbols in the various drawings indicate like elements.

DETAILED DESCRIPTION

Figure 1:
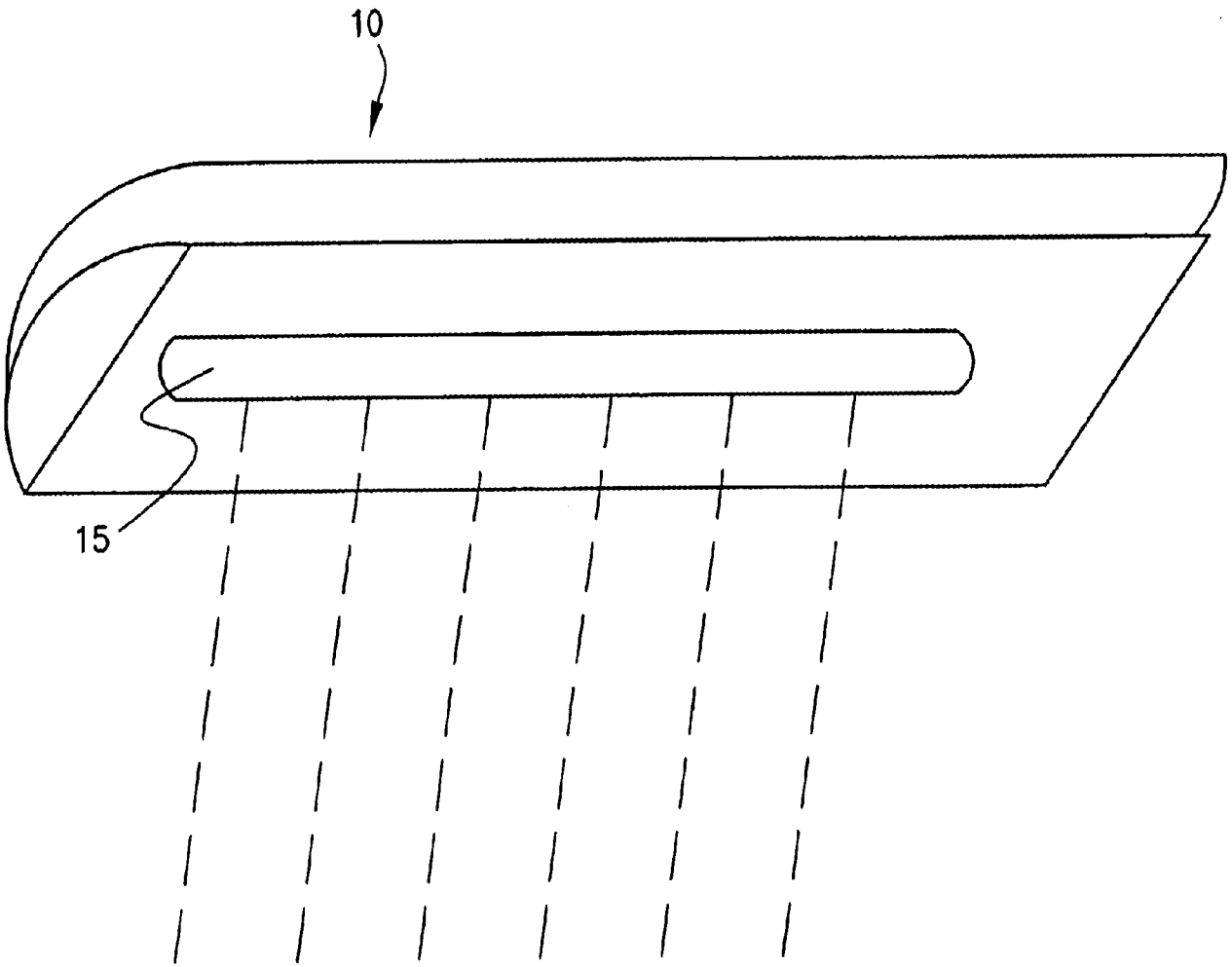
FIGS. 1–4 are perspective views of a conventional fluorescent lamp fixture with conventional diffusers.
Figure 2:
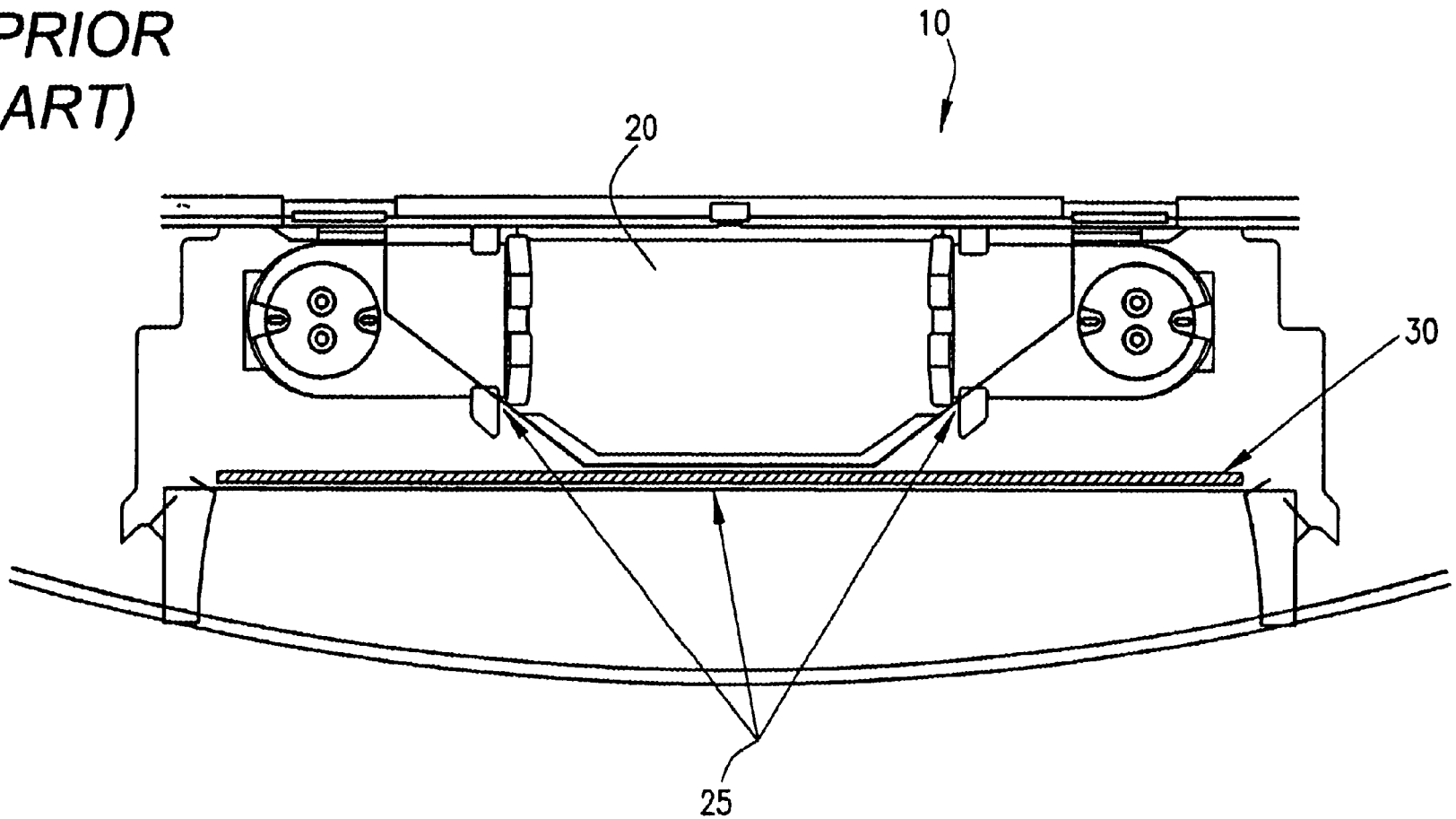
Figure 3:
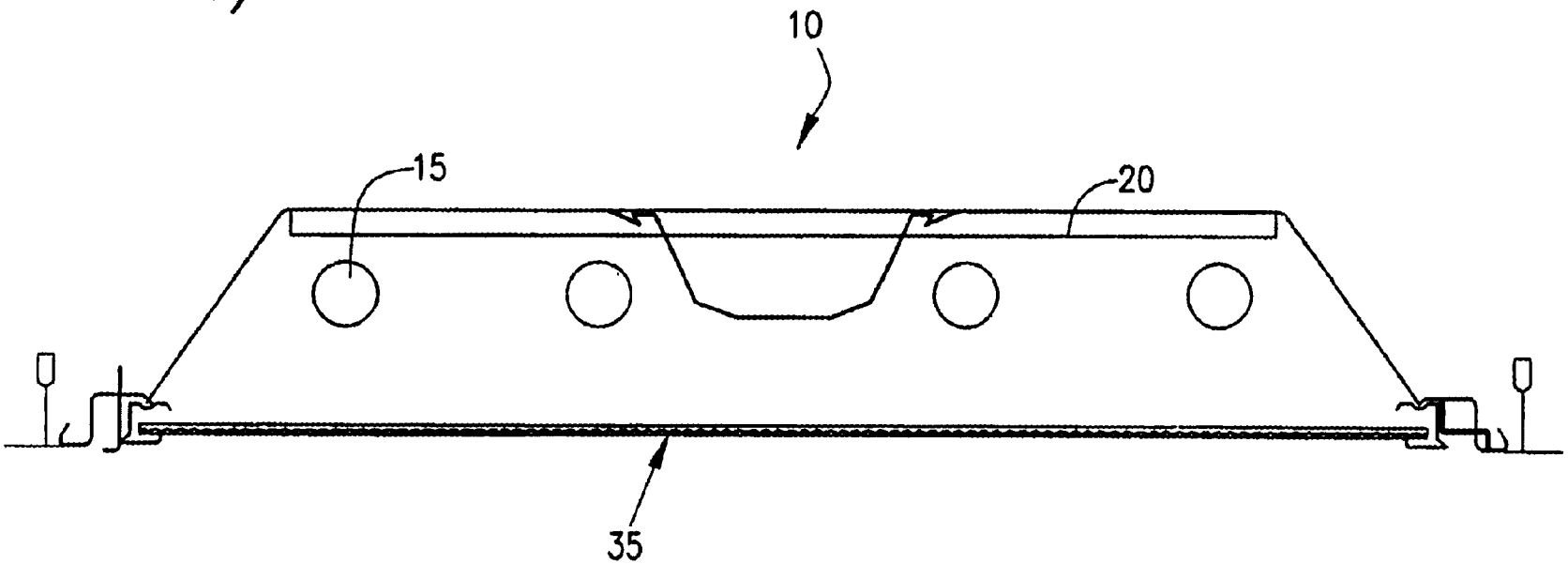
Figure 4:
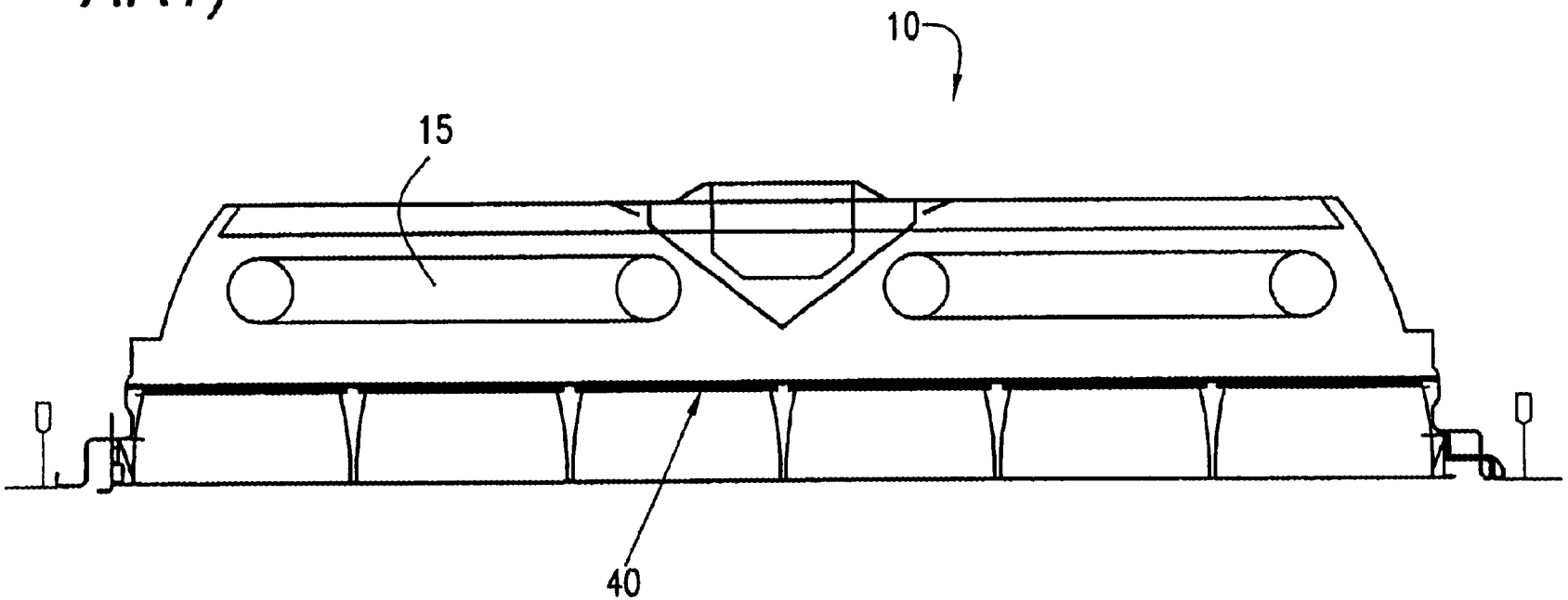
Figure 5:
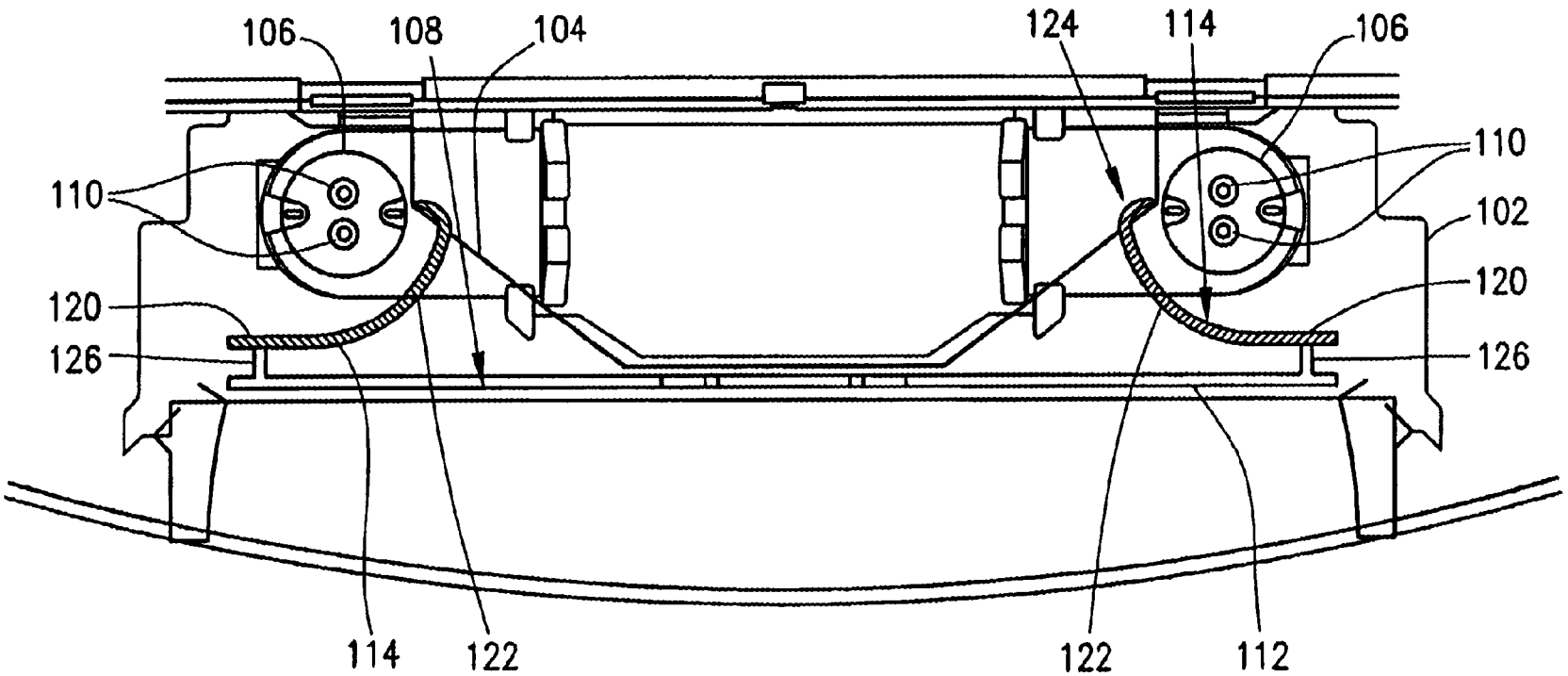
FIG. 5 is a perspective view of a high output lamp fixture with a high output lamp softener.
Figure 6:
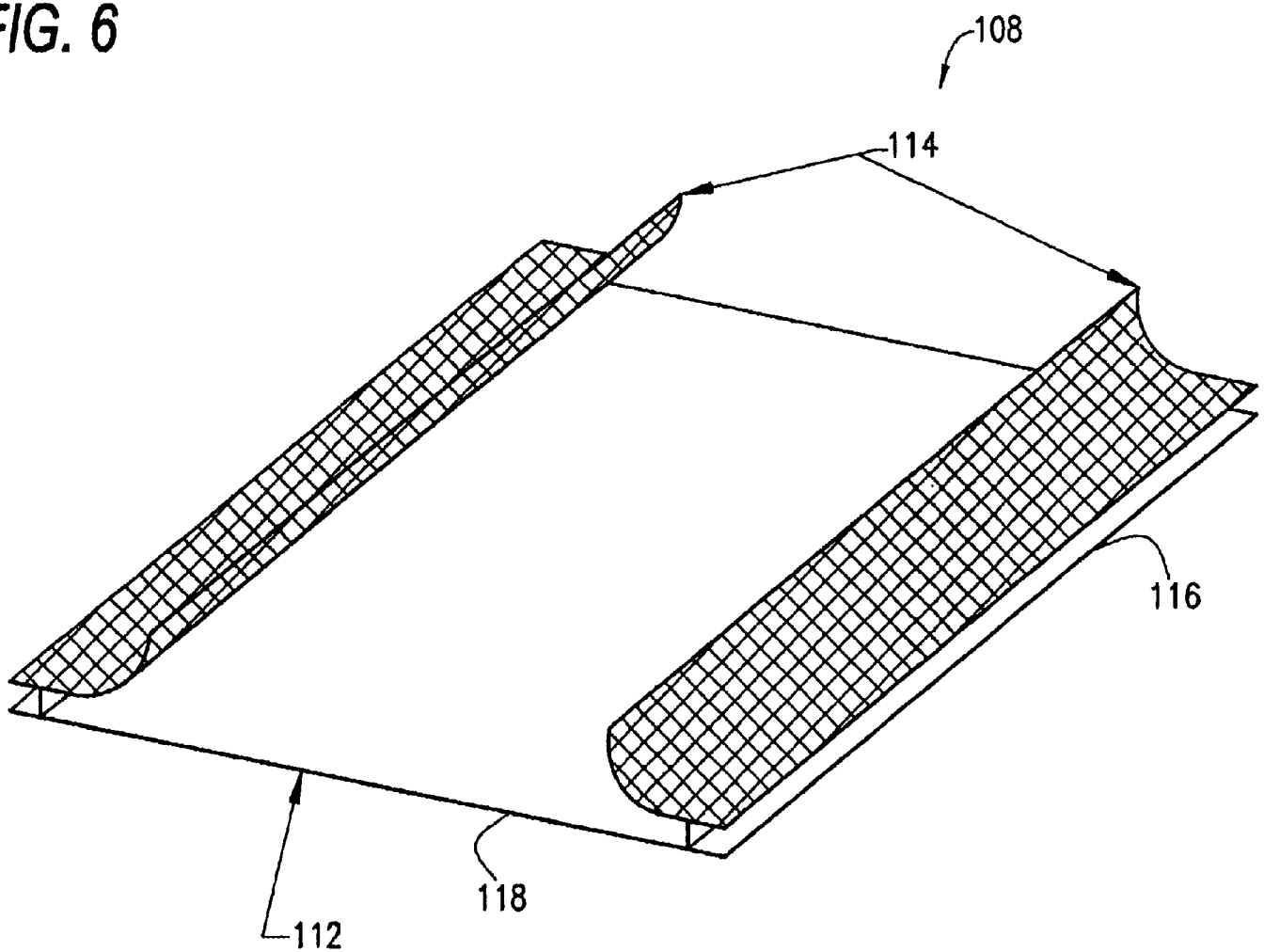
FIG. 6 is a perspective view of the high output lamp softener of FIG. 5.
Figure 7:
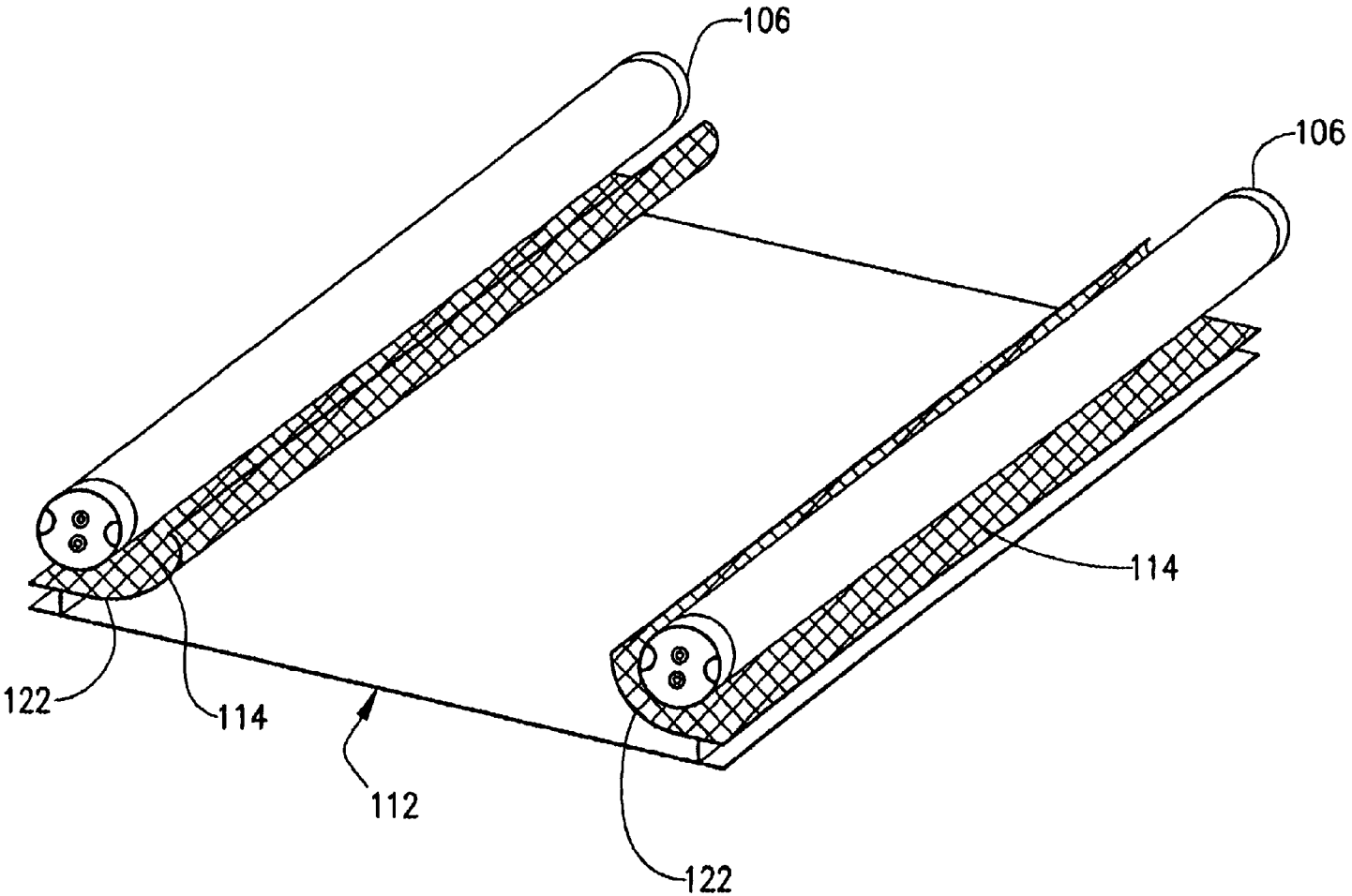
FIG. 7 is a perspective view of the high output lamp softener of FIG. 5 and a high output fluorescent lamp.

Referring to FIGS. 5–7, a high output lamp fixture 100 includes a housing 102, a reflector 104, one or more high output fluorescent lamps 106, and a high output lamp softener 108. The reflector 104 is positioned inside the housing 102 adjacent to, and above or behind, the lamps 106 to form separate compartments for each of the high output fluorescent lamps 106.

The housing 102 can be any housing that is configured to retain a lamp, whether the fixture is recessed, hanging, or mounted in another manner.

The reflectors 104 reflect light from the lamps 106 and the arrangement of the reflectors affects the distribution of the light in the room in which the fixture 100 is placed. The reflectors also capture and reflect light that is not otherwise directed to the area to be illuminated. As such, the surface of the reflector is important in reflecting light. Thus, the more reflective the surface, the more likely light will be captured and reflected. For example, the reflectors 104 include sections or reflective surfaces that are behind the lamps and which reflect light down that otherwise would be lost because it is directed at an area that is not important for illumination. Similarly, the reflectors include sections or reflective surfaces that are adjacent to the inside portion of the lamp and which reflect light that otherwise would not be directed down to the area to be illuminated. The reflectors optionally also can include sections or reflective surfaces that are adjacent to the outside portion of the lamp and which also reflect light that would otherwise not be directed down to the areas to be illuminated. The reflectors 104 also can be curved to provide a semi-circular enclosure around a part of the circumference of the lamp.

The high output fluorescent lamps 106 include pin contacts 110 at each end for electrical and mechanical connection to the lamp fixture sockets (not shown). The high output lamp softener 108 does not interfere with the mounting of the lamps 106 in the lamp fixture 100 and, as such, the lamps are installed in the fixture using conventional techniques. The lamps 106 can be of any length and the softener 108 can be fabricated to be of a similar length to match the lamp and the fixture 100.

The high output lamp softener 108 includes a flat base 112 and shaped lamp diffusers 114. The base 112 has a rectangular shape with long edges 116 and wide edges 118 approximately aligned with the bottom of the housing 102. Because the base 112 is positioned below the shaped diffusers 114, a person below the lamp softener 108 looking up at the lamp fixture will not see the diffusers. Instead, the person will see a light source that provides a well-distributed source of light across the base 112 without the visual distractions that could be caused by the variations in shape that result from using the shaped diffusers 114.

The shaped diffuser 114 has a lower, flat portion 120 and a curved portion 122 that extends from the flat portion and arcs upward and toward the center of the fixture 100. The curved portion 122 has a curvature that generally follows the curvature of the lamp 106 and terminates at a tip 124. The tip 124 can be configured for mounting the softener 108 to the reflector 104. For example, the tip 124 of the curved portion 122 shown in FIG. 5 is bent backward for contact with the reflector surface. The reflector surface may include a slot through the reflector in which the tip 124 is inserted, one more spring clips in which the tip is inserted, or a plate that extends from the reflector to form a channel in which the tip is inserted. In general, the tip 124 can be mounted to the reflector 104 in any manner that ensures a secure mounting of the tip to the reflector. Of course, the softener 108 can be mounted to the fixture 100 in any variety of manners. For example, the base 112 of the high output lamp softener can be mounted to the reflector 104 by a screw (not shown). In another implementation, the base can include one or more mounting tabs that are inserted into corresponding mounting holes in the reflector. In a further implementation, the tip 124 of the shaped diffuser 114 can be secured to the reflector 104 by a screw or other mounting means.

A connecting ridge 126 extends from the flat portion 120 at a position near the long edge 116 of the base 112 and integrally joins the base to attach the base 112 to the shaped diffuser 114. The length of the connecting ridge 126 can be varied depending upon the application. For example, if the reflector extends down a relatively large distance, the connecting ridge 126 can be a relatively long length and if the reflector extends down a relatively short distance, the connecting ridge can be a relatively short length. The connecting ridge 126 can be positioned at any position along the length of the base 112 and extend to any position along either the flat portion 120 or the curved portion 122. For example, the connecting ridge can extend from the outer most point along the long edge 116 and connect to the outermost point of the connecting ridge 126. The connecting ridge 126 also can extend from a point more to the center of the base 112 and connect any point of the diffuser 114.

Referring specifically to FIG. 7, the curved portion 122 maintains a relatively constant distance between the surface of the shaped diffuser 114 and the surface perimeter of the high output fluorescent lamp 106. A benefit of this feature is that the apparent illumination through the diffuser will be relatively constant across its surface. Since the shaped diffuser 114 encircles a portion of the fluorescent lamp 106, the diffuser 114 is wider than the fluorescent lamp 106. Thus, the apparent light source through the diffuser 114 is wider. However, the shaped diffuser 114 is still within close proximity to the lamp 106 in order to minimize the absorption of reflected light from the fixture. In its proper position the shaped diffuser 114 reduces direct lighting from the fluorescent lamp to a comfortable level while minimizing the reduction in reflected light from the fixture relative to a lamp fixture having an overlay, a lens, or a sheet diffuser. The curvature of the curved portion 122 can be varied to tailor the apparent illumination. For example, if the configuration of the reflector surface causes dim spots or regions of lower intensity of the illumination, the curvature can be brought closer at that region.

The base 112 and the shaped diffuser 114 are manufactured as one integral component by, for example, co-extrusion, injection molding, compression molding, extrusion, or casting. Of course, the base 112 and the shaped diffuser 114 can be formed as separate components, using any of the methods described above, that are then fixed together. For example, the base 112 can be separately formed and two separate diffusers 114 can be separately formed, and then the separate parts adhered together with an adhesive, connected with clips, or attached together using another mounting or attachment device.

The base 112 is made from a clear plastic that is nearly 100% light transmissive. In other implementations, the base 112 may be made from clear acrylic, or polycarbonate materials. In a further implementation, the base may be translucent or partly light transmissive. The base 112 also may have a surface pattern such as squares, circles, diamonds, or ridges to increase light dispersion.

The shaped lamp diffuser 114 is made from a translucent extruded plastic that is impregnated with a milky-white additive, or any other additive or filler, such as an opaque filler, that reduces the light transmission through the plastic. In other implementations, the shaped lamp diffuser 114 can be made from a translucent material such as acrylic or polycarbonate with or without an additive or filler, such as an opaque filler, that reduces the light transmissivity of the diffuser. The transmissive properties of the lamp diffuser 114 allow between approximately 50% and 90%, more particularly between approximately 60% and 80%, and even more particularly approximately 70% of the total light to be transmitted from the lamp 106. The transmissive properties of the shaped diffuser 114 reduce the output of the high output lamp to a level of 25% to 35% more than the light provided by a standard fluorescent lamp. In another implementation, the transmissive properties of the shaped diffuser reduce the output of the high output lamp to the same level of light provided by a standard fluorescent lamp.

Figure 8:
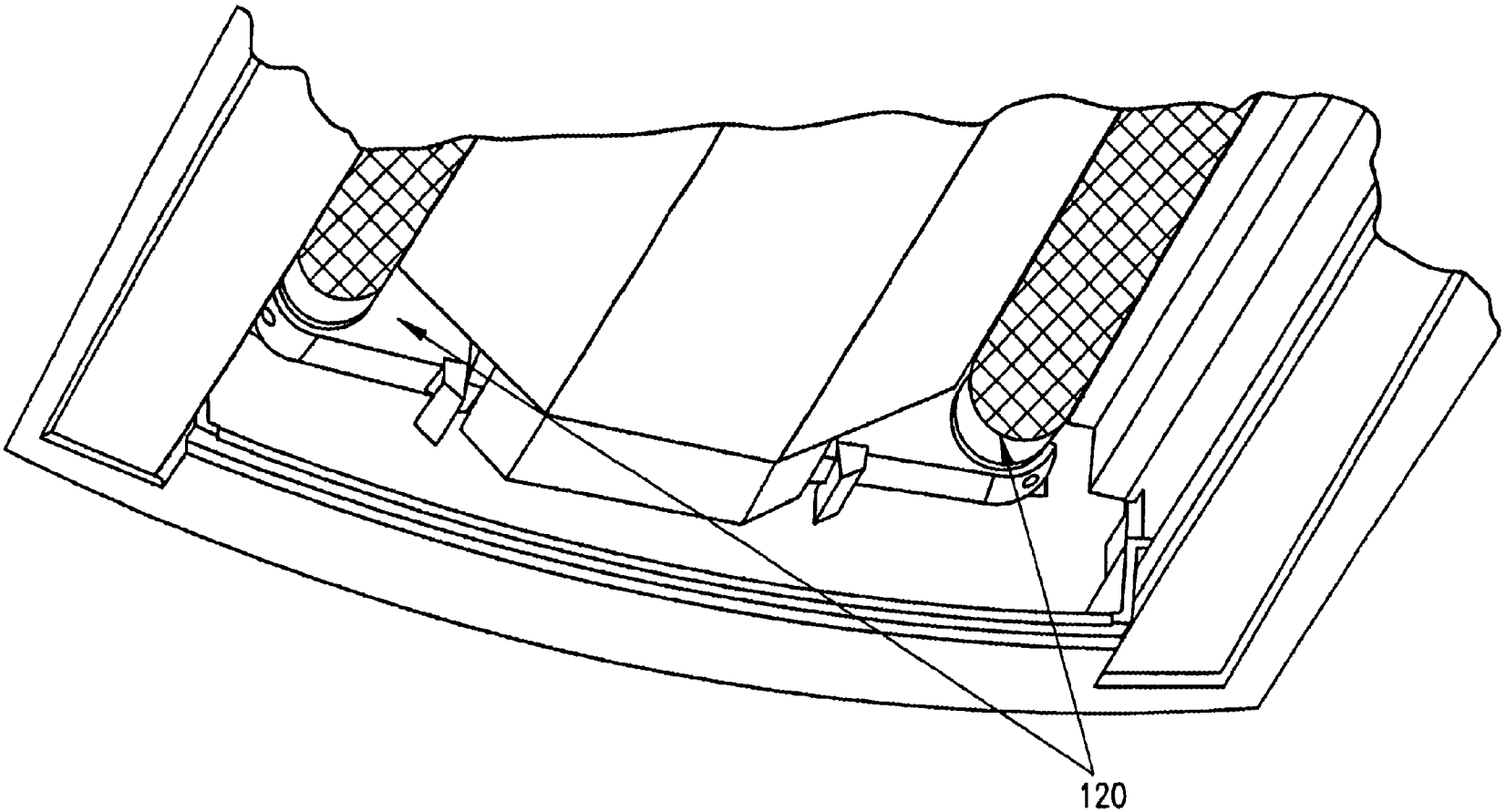
FIG. 8 is a perspective view of the fluorescent lamp fixture of FIGS. 1–4.
Figure 9:
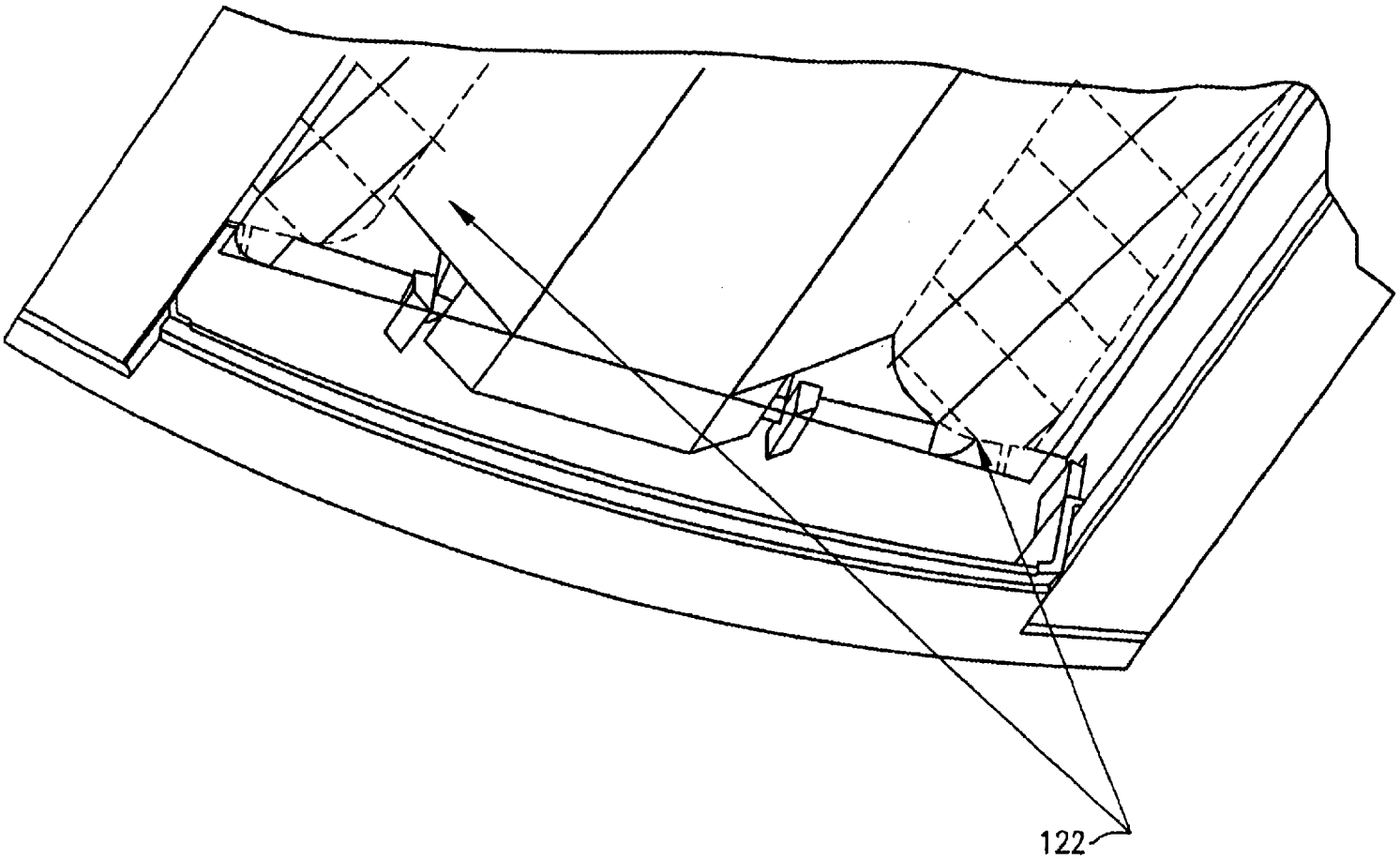
FIG. 9 is a perspective view of the high output lamp fixture of FIG. 5.

FIGS. 8 and 9 show the contrast in the resulting apparent light from the softener 114 in comparison to a lamp fixture without the softener or a diffuser. For example, referring to FIG. 8, the apparent light source 120 from a lamp fixture without a diffuser is shown by the hatched area. Essentially, the apparent light source is confined to the surface of the high output fluorescent lamp. In contrast, referring to FIG. 9, the apparent light source 122 from a lamp fixture with the shaped diffuser 114 is represented by the hatched area. The configuration of the shaped diffuser causes the apparent light source to be much wider by appearing to emanate from the surface of the shaped diffuser.

Figure 10:
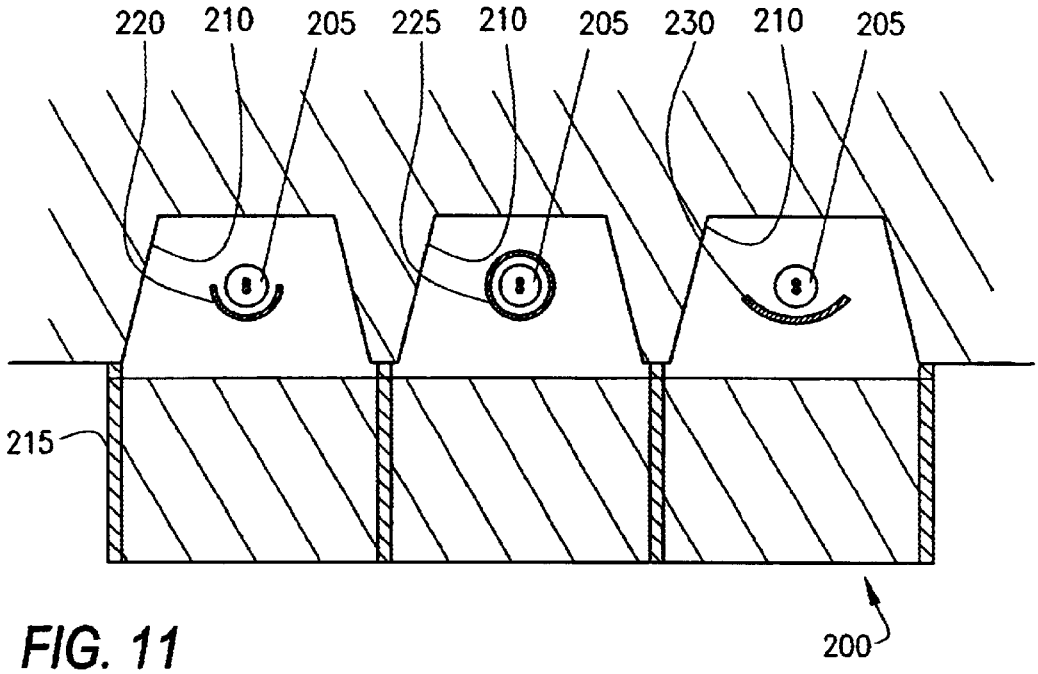
FIGS. 10 and 11 are end and bottom views of a lamp fixture having lamp softeners.
Figure 11:
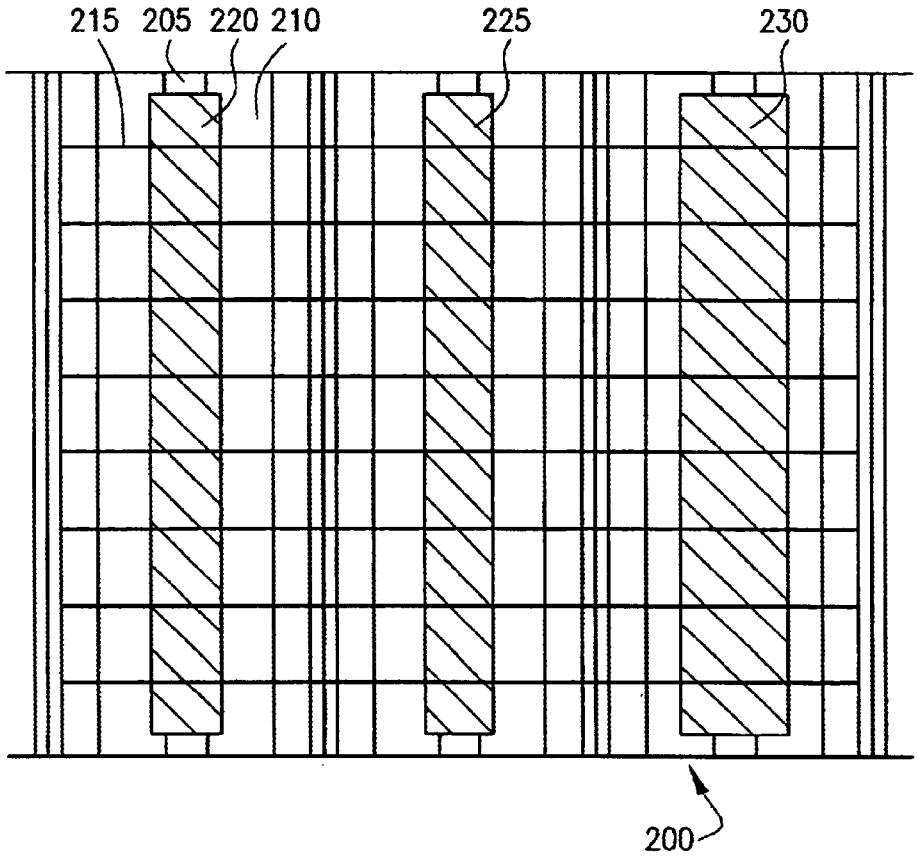

The softeners and diffusers described herein can be configured as a shaped lamp softener or diffuser that mounts to the lamp or around the lamp. Referring to FIGS. 10 and 11, a lamp fixture 200 includes one or more lamps 205, a housing 210, and a reflector 215. The housing 210 has surfaces that function as reflective surfaces to illuminate the space below the lamp fixture 200. The reflector 215 can be, for example, configured as a reflective baffle arrangement with baffles at perpendicular angles to one another. The baffles reflect light from the lamps to provide illumination below the lamp fixture 200. The reflector 215 optionally can be used with or replaced by a lens (not shown) below the lamp fixture 200.

The lamp fixture also includes one or more lamp softeners. As illustrated in FIGS. 10 and 11, the lamp softeners can have a variety of configurations. In general, the lamp softeners are configured and positioned adjacent to the lamp such that they reduce the apparent illumination seen below the lamp while simultaneously allowing the light from the lamp to reflect from the reflective surface of the lamp fixture, including those of the reflector or baffles and the housing. The softener can include a fastener to mount the softener to the lamp, any part of the lamp fixture, or to another surface. Thus, the softener provides illumination that is a mixture of direct lighting through the softener and light reflected from the reflective surfaces of the fixture. In general, the lamp softeners are not placed so far from the lamp that they cause the illumination below the lamp fixture 200 to be entirely from the lamp softener and not reflected off of any of the reflective surfaces of the lamp fixture. For example, a lamp softener 220 encircles approximately one half of the circumference of the lamp 205. The softener 220 is positioned such that the output from the lamp from half of the circumference of the lamp passes through the softener and the other half of the output of the circumference of the lamp is reflected off of surfaces of the housing 210 encircling or surrounding part of the lamp 205. In this manner, the apparent lighting from the lamp is spread over a wider area and, if the lamp is a high output lamp, the apparent lighting is not uncomfortably bright.

A lamp softener 225 is placed around the lamp 205 and encircles the complete circumference of the lamp. In this manner, the output from the entirety of the lamp passes through the softener and then part of that output reflects off of the reflective surfaces of the housing 210. In this manner, the apparent lighting from the lamp is spread over a wider area and, if the lamp is a high output lamp, the apparent lighting is not uncomfortably bright.

A lamp softener 230 encircles approximately two thirds of the circumference of the lamp 205 and is closest to the lamp below the lamp and is further away from the lamp at the lamp's sides. The output from the lamp from part of the circumference of the lamp passes through the softener and the other portion of the output of the circumference of the lamp is reflected off of surfaces of the housing 210 encircling the lamp 205. In this manner, the apparent lighting from the lamp is spread over a wider area and, if the lamp is a high output lamp, the apparent lighting is not uncomfortably bright.

Figure 12:
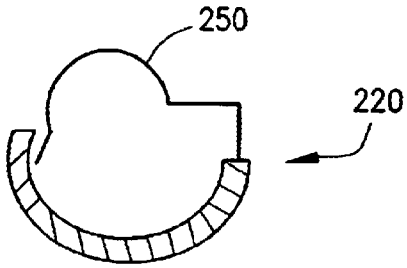
FIGS. 12–18 are end and perspective views of the softeners of FIGS. 10 and 11 illustrating mounting clips to mount the softeners to lamps.
Figure 13:
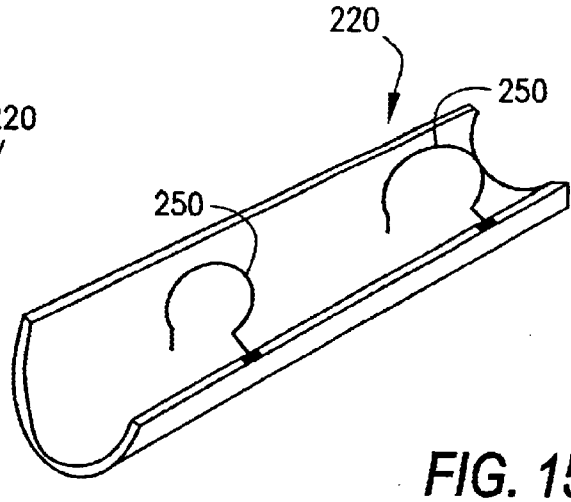

The lamp softeners 220, 225, 230 can be mounted to one or more of the lamp 205, the housing 210, and/or the baffles 215 using any type of fastener. For example, referring to FIGS. 12 and 13 the softener 220 includes one or more mounting fasteners or clips 250 extending from the softener. The clips can be integral with the softener or mounted to the softener. The clips 250 are configured to fit snugly around the lamp 205 by pressing the clip against the lamp such that it expands to receive the lamp and then contracts around the circumference of the lamp. The clips 250 can be configured to have a flared opening to ease the placement of the clips around the lamp. With the clips 250, the softener 220 can be mounted on an installed lamp or mounted to a lamp prior to installation in the fixture.

Figure 14:
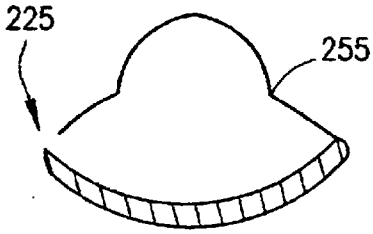
Figure 15:
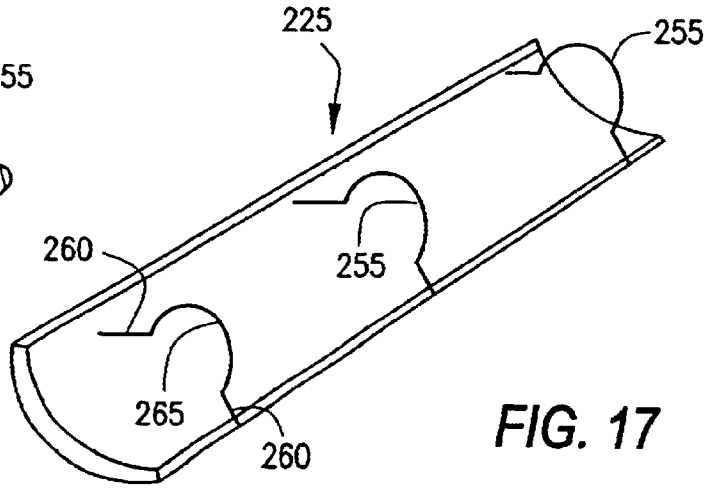

Referring to FIGS. 14 and 15, the softener 225 includes fasteners or clips 255 that are used to mount the softener 225 to a lamp. The clips extend from the edge of the softener and mount around the lamp to retain the softener to the lamp. The clips 255 include a pair of arms 260 and a rounded portion 265. The rounded portion 265 encircles the lamp 205 and one or more of the arms 260 attach to and extend from the softener. If one arm 260 extends from the softener and the other arm does not, the clip 255 can be flexibly bent to allow placement over an installed lamp. If both arms 260 attach to and extend from the softener, the softener must be mounted to the lamp prior to installation of the lamp in the fixture. The clips 255 can be integral with the softener or mounted to the softener.

Figure 16:
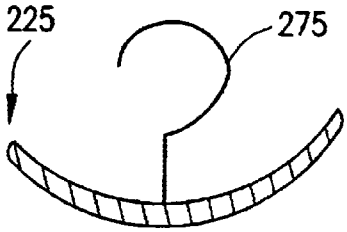
Figure 17:
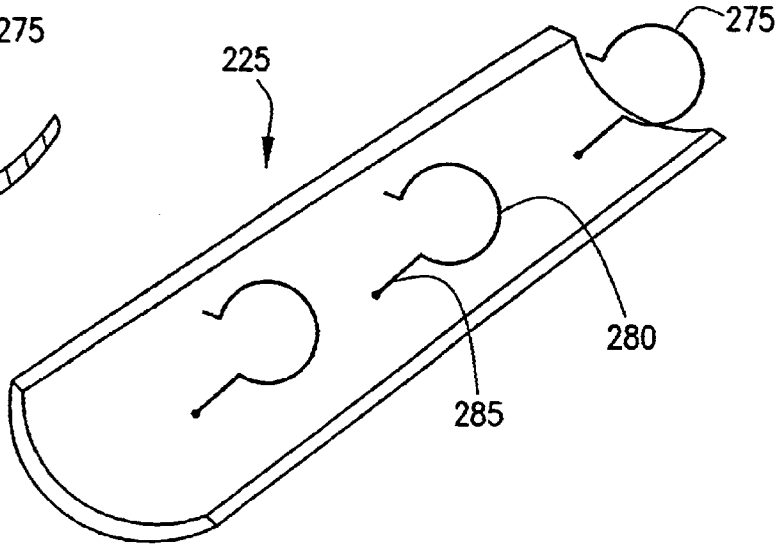

Referring to FIGS. 16 and 17, the softener 225 includes fasteners or clips 275 that extend from a mid-region of the softener. The clips include a rounded portion 280 that is configured to encircle the lamp 205 and a base portion 285 that extends from the softener to the rounded portion. The clips can be integral with the softener or mounted to the softener. For example, the base portion 285 can be mounted to the softener when it is formed or it can be affixed later.

Figure 18:
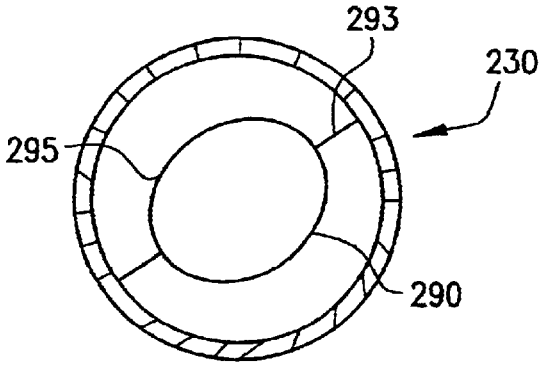

Referring to FIG. 18, the softener 230 includes one or more fasteners or clips 290 that are mounted within an inner channel of the softener. The clip 290 includes one or more arms 293 and a ring 295. The ring has an inner diameter that is greater than the outer diameter of the lamp. In this manner, the lamp is inserted through the rings and the lamp then is installed in the lamp fixture 200.

The softeners 220, 225, 230 are fabricated by, for example, extrusion, molding or any other plastic fabrication technique, from a polymer to which an additive or filler, such as an opaque filler, has been added to reduce the light transmissivity of the resulting lamp softener. One or more colored filler also can be used to provide tinting effects to the lighting or otherwise color the lighting. The softeners also can be made from a translucent material such as acrylic or polycarbonate with or without an additive or filler, such as an opaque filler, that reduces the light transmissivity of the softener. The transmissive properties of the lamp softener allow between approximately 50% and 90%, more particularly between approximately 60% and 80%, and even more particularly approximately 70% of the total light to be transmitted from the lamp 205. The transmissive properties of the softener reduce the output of a high output lamp to a level of 25% to 35% more than the light provided by a standard fluorescent lamp. In another implementation, the transmissive properties of the softener can be configured to reduce the output of the high output lamp to the same level of light provided by a standard fluorescent lamp.

Figure 19:
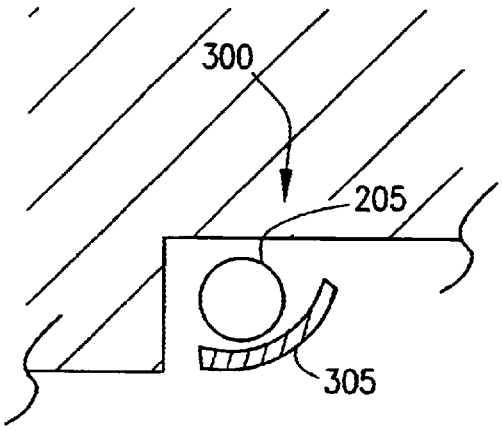
FIGS. 19–21 are end views of comer lamp fixtures and softeners.
Figure 20:
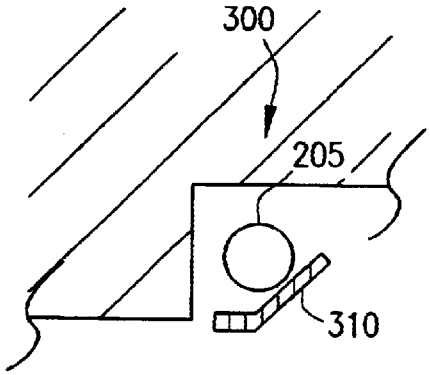
Figure 21:
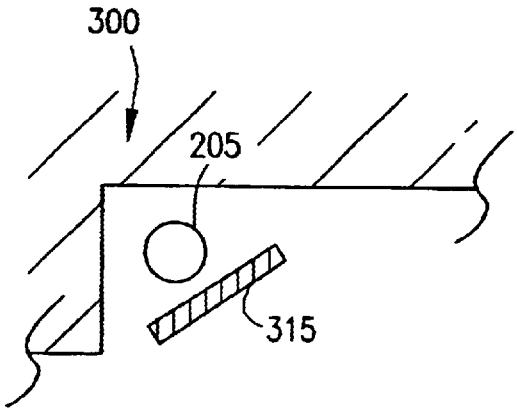

A number of implementations of a high output lamp softener have been described. For example, referring to FIGS. 19–21, the lamp 200 can be installed in a corner lamp fixture 300 and a softener placed adjacent to the lamp to soften the apparent lighting. Although the softener can be a curved softener 305 (FIG. 19), the softener also can be a generally planer softener 310 that includes an angle between two segments (FIG. 20) or is simply formed from one flat sheet (FIG. 21) and placed adjacent to the lamp to affect the lighting directly emanating from the lamp but yet provide reflected lighting from the fixtures reflective surfaces. Nonetheless, it will be understood that various modifications may be made. Accordingly, other implementations are within the scope of the following claims.

What is claimed is:

1. A lighting system, comprising:

a pair of elongated lamps arranged substantially parallel to each other in a plane;

a reflector, arranged between the lamps and extending through the plane, for reflecting light from the lamps;

a pair of diffusers, each diffuser extending from the reflector and below the plane, for distributing light from the lamps across the reflector.

2. The lighting system recited in claim 1, further comprising a translucent base arranged below the reflector and the diffusers for receiving light from the reflector and the diffusers.

3. The lighting system recited in claim 2, wherein each diffuser extends from the reflector to an edge of the base.

4. The lighting system recited in claim 3, wherein each diffuser is secured to an edge of the base.

5. The lighting system recited in claim 4, wherein the base further comprises a pair of connecting ridges, each connecting ridge arranged on an opposite edge of the base for securing to the corresponding diffuser.

6. The lighting system recited in claim 2, wherein at least a portion of top surface of the base abuts a bottom surface of the reflector.

7. The lighting system recited in claim 6 wherein the bottom surface of the reflector has a shape corresponding to a shape of the abutting surface of the base.

8. The lighting system recited in claim 7 wherein the bottom surface of the reflector is substantially flat.

9. The lighting system recited in claim 1 wherein each diffuser transmits between approximately 60% and 80% of incident light.

10. A lighting system, comprising:

a pair of elongated lamps arranged substantially parallel to each other in a plane;

reflector means, arranged between the lamps and extending through the plane, for reflecting light from the lamps;

curved diffuser means, extending from each side of the reflector, for distributing light from the lamps across the reflector.

11. The lighting system recited in claim 10 further comprising translucent means, arranged below the reflector means and the diffusers means, for receiving light from the reflector and its diffuser.

12. The lighting system recited in claim 10 further comprising reflector connecting means for securing the diffuser means to the reflector means.

13. The lighting system recited in claim 10 further comprising translucent connecting means for securing the diffuser means to the translucent means.

14. The lighting system recited in claim 12 further comprising translucent connecting means for securing the diffuser means to the translucent means.

15. The lighting system recited in claim 11 wherein the reflector means abuts a top surface of the translucent means.

16. The lighting system recited in claim 14 wherein the reflector means abuts a top surface of the translucent means.

17. The lighting system recited in claim 14 wherein the diffuser means transmits between approximately 60% and 80% of incident light.

18. The lighting system recited in claim 16 wherein the diffuser means transmits between approximately 60% and 80% of incident light.

* * * * *